US006125905A

United States Patent [19]

Woodside et al.

[11] Patent Number: 6,125,905

[45] **Date of Patent: *Oct. 3, 2000**

[54] PROTECTIVE COVERINGS

[75] Inventors: Margaret Mary Woodside, Pickerington; Frank Joseph Macdonald; Jeri Oliver Clark, both of Granville; Joseph Martine Lehman, Columbus, all of Ohio; Scott Alan Calvert, Louisville, Ky.

[73] Assignee: Owens Corning Fiberglas Technology, Inc., Summit, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,066

[22] Filed: Aug. 26, 1997

[51] Int. Cl.[7] ..... E04F 10/06

[52] U.S. Cl. ..... 160/67; 160/269; 160/DIG. 7

[58] Field of Search ..... 160/67, 66, 72, 160/73, 22, 268.1, DIG. 7, 269

[56] References Cited

U.S. PATENT DOCUMENTS

| | | | |
|---|---|---|---|
| 506,537 | 10/1893 | O'Donnell . | |
| 1,493,161 | 5/1924 | Raper . | |
| 1,677,646 | 7/1928 | Meyers . | |
| 1,779,561 | 10/1930 | Schuler | 160/72 |
| 1,983,617 | 12/1934 | Ladon | 160/DIG. 7 X |
| 2,028,670 | 1/1936 | Hoskins | 160/DIG. 7 X |
| 2,065,402 | 12/1936 | Schweller | 160/DIG. 7 X |
| 2,281,635 | 5/1942 | Strauss | 160/DIG. 7 X |
| 2,381,542 | 8/1945 | Hyatt et al. | 160/DIG. 7 X |
| 2,473,305 | 6/1949 | Schmaus | 160/268.1 |
| 2,871,933 | 2/1959 | Kroger . | |
| 2,906,323 | 9/1959 | Macy . | |
| 3,151,664 | 10/1964 | Tradelius | 160/72 |
| 3,831,319 | 8/1974 | Warner . | |
| 4,088,525 | 5/1978 | Gowetski et al. . | |
| 4,234,633 | 11/1980 | Gowetski et al. . | |
| 4,294,302 | 10/1981 | Ricke, Sr. . | |
| 4,301,851 | 11/1981 | Gitkin . | |
| 4,356,678 | 11/1982 | Andrews et al. . | |
| 4,369,829 | 1/1983 | Casiday . | |
| 4,399,855 | 8/1983 | Volfson . | |
| 4,509,576 | 4/1985 | Giovanni | 160/66 |
| 4,748,064 | 5/1988 | Harpell et al. . | |
| 4,781,235 | 11/1988 | Hedstrom et al. . | |
| 4,799,525 | 1/1989 | Seymour . | |
| 4,885,205 | 12/1989 | Wahl et al. . | |
| 4,931,358 | 6/1990 | Wahl et al. . | |
| 5,087,657 | 2/1992 | Qureshi et al. . | |
| 5,185,117 | 2/1993 | Hawley . | |
| 5,248,373 | 9/1993 | Minnick et al. . | |
| 5,251,414 | 10/1993 | Duke . | |
| 5,268,223 | 12/1993 | Qureshi et al. . | |
| 5,314,153 | 5/1994 | White | 160/67 X |
| 5,353,563 | 10/1994 | White . | |
| 5,369,850 | 12/1994 | Noble | 160/67 X |
| 5,443,563 | 8/1995 | Hindel et al. . | |
| 5,456,305 | 10/1995 | Snarli . | |
| 5,592,790 | 1/1997 | Requejo . | |
| 5,592,982 | 1/1997 | Murray et al. | 160/67 |
| 5,626,643 | 5/1997 | Woodside et al. . | |
| 5,789,078 | 8/1998 | Eikleberry et al. . | |

OTHER PUBLICATIONS

Jung, Advanced Polymer Composites, p. 69,. 1994.

"The Long And Short Of Fiber–Reinforced Thermoplastics".

"Metal Replacements" by Vicki P. McConnell, pp. 35–48, Plastic Design Forum (Dec., 1989).

"Advancements In Glass Reinforced Thermoplastics—The Long And The Short Story"by Richard M. Wenger and Steven R. Gerteisen, Akze Engineering Plastics, Inc.

*Primary Examiner*—David M. Purol
*Attorney, Agent, or Firm*—Inger H. Eckert

[57] ABSTRACT

Protecting coverings are provided for glass windows and the like. The protective coverings comprise a fiber reinforced polymeric fabric flexible enough to be rolled upon itself.

15 Claims, 8 Drawing Sheets

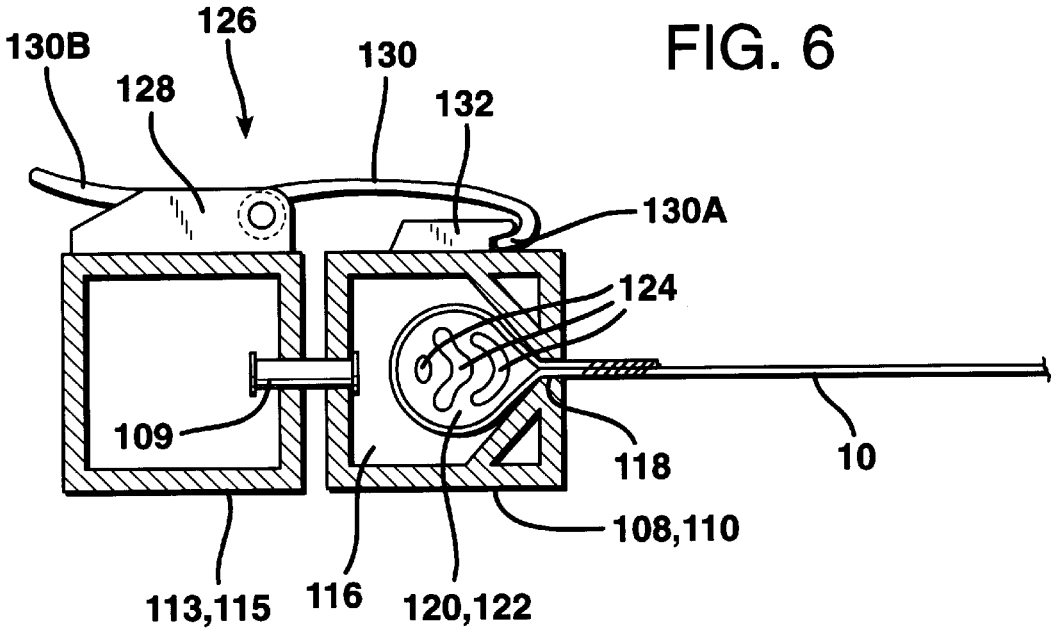
FIG. 6
FIG. 7
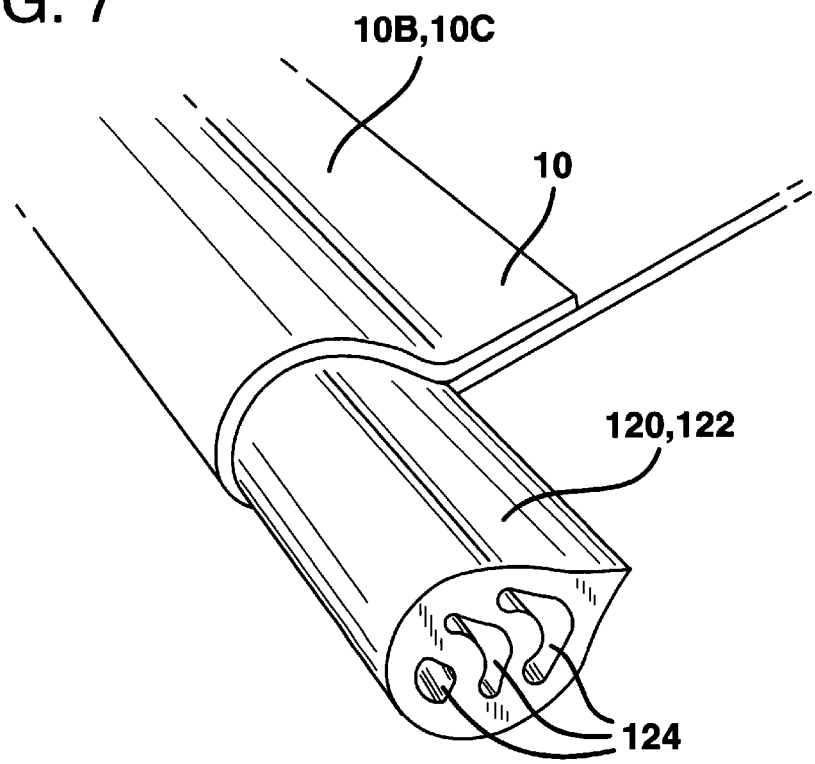

PROTECTIVE COVERINGS

CROSS REFERENCE TO RELATED APPLICATION

This application is related to commonly assigned U.S. patent application Ser. No. 08/778,942, titled "IMPACT AND PUNCTURE RESISTANT SHUTTERS, " by Margaret M. Woodside et al., filed Jan. 6, 1997, and U.S. patent application Ser. No. 08/920,019 titled "PROTECTIVE COVERINGS," by Margaret M. Woodside et al., filed concurrently herewith, the disclosures of which are herein incorporated by reference.

TECHNICAL FIELD AND INDUSTRIAL APPLICABILITY OF THE INVENTION

The present invention relates to protective coverings for glass windows and the like and, more particularly, to protective coverings comprising impact and puncture resistant fabric formed from strand material which includes reinforcing fibers and polymeric material.

BACKGROUND OF THE INVENTION

Impact and puncture resistant structures are useful in many applications, including as protective coverings for cash windows of financial institutions, coverings for kiosks and carts in open areas of shopping malls, side panels for tractor trailers, boat hulls, aircraft parts and other articles and parts for which impact resistance and/or puncture resistance are desired. By way of example only, the prior use of such structures as shutters or window covers shall now be described. Buildings and houses located in areas prone to severe weather conditions, such as hurricanes and tornados, are often exposed to wind borne debris during those severe weather conditions. Windows and doors, especially those made of glass, are most vulnerable to wind borne debris, such as tree branches, rocks and portions of surrounding structures.

Shutters made of aluminum and steel are currently used to protect vulnerable portions of buildings and houses because shutters made from these materials can be manufactured to meet building and housing codes in regions which experience severe weather conditions. However, steel and even aluminum shutters undergo pitting and strength degradation associated with corrosion, particularly in regions along the sea coast, where the air contains a high concentration of corrosive salt. In addition, metal shutters can be somewhat heavy. Further, metal shutters are substantially opaque thereby preventing exterior light from passing through the window or structure being protected and into the house or building in question.

Accordingly, there is a particular need for protective coverings which can prevent the penetration of wind borne debris during severe weather conditions, are corrosion resistant and are relatively lightweight. There is also a more general need for protective coverings that are relatively inexpensive to produce and readily adapted to various applications and strength requirements. Preferably, such a structure is flexible enough to be rolled upon itself for ease of storage.

SUMMARY OF THE INVENTION

The present invention satisfies the current needs in the art by providing protective coverings comprising a fiber reinforced polymeric matrix fabric, which is relatively resistant to penetration, inexpensive, corrosion resistant, lightweight, translucent and flexible enough to be rolled upon itself.

According to a first aspect of the present invention, a protective covering is provided for protecting at least a portion of an element secured in a structure. The covering comprises a fiber reinforced polymeric fabric and a support apparatus coupled to the structure for supporting the fabric adjacent to the element. The fabric is capable of covering the portion of the element and is flexible enough to be rolled upon itself. The support apparatus may comprise a roller. A first end of the fabric is secured to the roller with the fabric being rolled on the roller when in a fully retracted position and substantially unrolled from the roller when in a fully extended position. The fabric may be rolled and unrolled from the roller automatically. Preferably, the roller comprises a torsion spring so that the fabric is tightly rolled on the roller.

The support apparatus may further comprise a first frame member and a second frame member positioned on opposing sides of the element. A first side of the fabric is secured within the first frame member and a second side of the fabric is secured within the second frame member. The protective covering may further include first and second elongated members coupled to and extending along the first and second sides of the fabric, respectively. Preferably, the first and second elongated members are received in the first and second frame members and sized so that first and second sides of the fabric are maintained within the first and second frame members, respectively, under the application of a predetermined force on the fabric. Preferably, the first and second sides of the fabric are wrapped around the first and second elongated members, respectively. The first and second elongated members may be formed from an elastic material such as rubber.

The support apparatus may further comprise a first tensioning device coupled to the first frame member for adjusting a position of the first frame member so as to place the fabric under tension. The support apparatus may further comprise a second tensioning device coupled to the second frame member for adjusting a position of the second frame member so as to place the fabric under tension. Each of the first and second tensioning devices may comprise a tensioning frame member positioned adjacent the first and second frame members and at least one draw latch for adjusting the position of the first and second frame members.

The support apparatus may further comprise first and second arms rotatably coupled to the structure on opposing sides of the element. One of either the roller or a second end of the fabric is coupled to the first and second arms while the other of either the roller or the second end of the fabric is coupled to the structure adjacent to a first end of the element between the opposing sides. The first and second arms are in a first position when the fabric is in the fully retracted position, a second position when the fabric is in the fully extended position, and at least one intermediate position when the fabric partially extends over the element. The fabric is preferably placed under tension when the first and second arms are in a third position rotated past the second position by a predetermined number of degrees. The support apparatus preferably comprises at least one locking element on each of the opposing sides of the element for securing first and second sides of the fabric to the structure.

According to another aspect of the present invention, a protective covering is provided for protecting a window mounted in a structure. The covering comprises a fiber reinforced polymeric fabric, a roller coupled to the structure adjacent to a first end of the window with a first end of the fabric secured to the roller, and a first frame member and a second frame member positioned on opposing sides of the window. A first side of the fabric is secured within the first frame member and a second side of the fabric is secured within the second frame member. The fabric is rolled on the roller when in a fully retracted position and substantially unrolled from the roller when in a fully extended position. A second end of the fabric is secured to the structure adjacent to a second end of the window such that the fabric substantially covers the window when the fabric is in the fully extended position. The protective covering may further include first and second elongated members coupled to and extending along the first and second sides of the fabric, respectively. The first and second elongated members are received in the first and second frame members and sized so that first and second sides of the fabric are maintained within the first and second frame members, respectively, under the application of at least a predetermined force on the fabric. The protective covering may further comprise a first tensioning device coupled to the first frame member and a second tensioning device coupled to the second frame member. The first and second tensioning devices adjust a position of the first and second frame members, respectively, so as to place the fabric under tension.

According to yet another aspect of the present invention, a combination awning and protective covering is provided for covering and protecting a window mounted in a structure. The covering comprises a fiber reinforced polymeric fabric, first and second arms rotatably coupled to the structure on opposing sides of the window, and a roller coupled to one of the first and second arms and to the structure adjacent to a first end of the window. A first end of the fabric is secured to the roller. The fabric is rolled on the roller when in a fully retracted position and is substantially unrolled from the roller when in a fully extended position. The other end of the fabric is secured to the other of the first and second arms and the structure adjacent to the first end of the window. The first and second arms are in a first position with the fabric in the fully retracted position, a second position with the fabric in the fully extended position, and at least one intermediate position as the fabric partially extends over the window. The fabric may be placed under tension when the first and second arms are in a third position rotated past the second position by a predetermined number of degrees. The combination awning and protective covering may further comprise a locking element on each of the opposing sides of the window for securing first and second sides of the fabric to the window.

The objectives, features and advantages of the present invention will become apparent upon consideration of the following detailed description, accompanying drawings and appended claims.

BRIEF DESCRIPTION OF THE DRAWINGS

FIG. 6 presents a sectional view of the shutter of FIG. 4, taken along lines 6—6.

FIG. 7 presents a perspective view of a side of the protective covering of FIG. 4.

DETAILED DESCRIPTION AND PREFERRED EMBODIMENTS OF THE INVENTION

Figure 1:
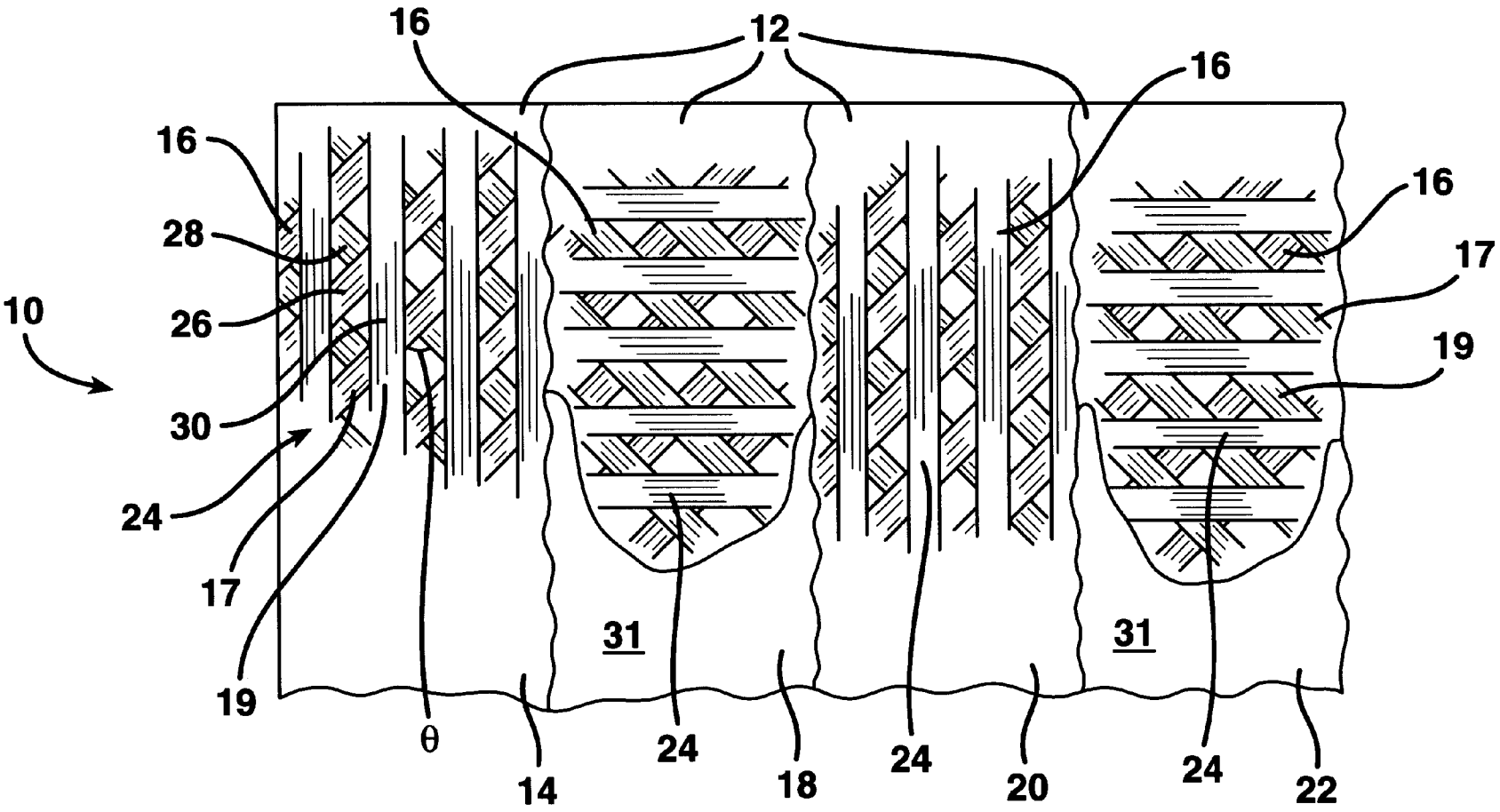
FIG. 1 presents a cutaway view showing the laminae of a fabric formed according to one embodiment of this invention.

The present invention is directed to a protective covering 5 comprising a fabric 10. The fabric 10 is a lamination of a plurality of laminae 12, each of which is formed from a plurality of reinforcement strands 16. Each strand 16 includes a plurality of reinforcing fibers 17 and at least one polymeric material 19. Useful reinforcing fibers can be any suitable reinforcing fiber including those selected from the group consisting of E-glass fibers, S-glass fibers, graphite fibers, aramid fibers, silicon carbide fibers, other fibers having suitable reinforcing characteristics and various combinations thereof. The polymeric material 19 can be any suitable polymeric material including a thermoplastic polymeric material selected from the group consisting of polyamides, polypropylenes, polyesters, polyethylenes, polyphenylene sulfides and other like thermoplastic materials.

The polymeric material 19 may be in the form of polymeric fibers which are commingled or combined with one or more reinforcing fibers 17 to form the strands 16. Methods for making commingled reinforcing and polymer fiber strands are disclosed in detail in U.S. Pat. No. 5,626,643 which is hereby incorporated by reference in its entirety. If commingled reinforcing-polymer fibers are used, it is desirable, though not required, for the weight ratio of reinforcing fibers to polymer fibers to range from about 40/60 to about 60/40. It can be more desirable for the weight ratio of reinforcing fibers to polymer fibers to be about 50:50.

Alternatively, the strands 16 may comprise a plurality of the reinforcing fibers 17 with the polymeric material 19 wire-coating or otherwise forming a layer around the reinforcing fibers 17 of each strand 16. These coated strands 16 may also include fibers made of the polymeric material 19 that are commingled with the reinforcing fibers 17. In addition, it may be desirable to use any combination of the above described strands 16 in making a fabric 10 according to the present invention. Examples of such strands 16 are disclosed in copending U.S. patent application Ser No. 08/695,909, filed Aug. 12, 1996, and entitled "CHEMICAL TREATMENTS FOR FIBERS AND WIRE-COATED COMPOSITE STRANDS FOR MOLDING FIBER-REINFORCED THERMOPLASTIC COMPOSITE ARTICLES," by Andrew B. Woodside, and in copending U.S. patent application Ser. No. 08/695,504, filed Aug. 12, 1996, and entitled "CHEMICAL TREATMENTS FOR FIBERS AND WIRE-COATED COMPOSITE STRANDS FOR MOLDING FIBER-REINFORCED THERMOPLASTIC COMPOSITE ARTICLES," by Andrew B. Woodside, the disclosures of which are hereby incorporated by reference.

Whether the strands 16 are formed by wire coating, commingling reinforcing and polymer fibers, or a combination thereof, it may or may not be desirable for the resulting strands 16 to be sized, impregnated or preimpregnated with a suitable chemical treatment. The cohesiveness of the fibers forming each of the strands 16 may be maintained by means of a suitable aqueous, nonaqueous, or solvent free chemical treatment. The chemical treatment can be applied so as to size the fibers before they are formed into a strand 16. However, to insure the cohesiveness of the fibers, it is desirable for the chemical treatment to be applied to the fibers in a sufficient amount to also at least partially, if not fully, preimpregnate the resulting strand 16. As an alternative, the chemical treatment can be partially or fully impregnated into a formed strand 16.

One chemical treatment that has been applied to maintain the cohesiveness of the fibers in the strand 16 is an aqueous based urethane chemical treatment available from Reichhold Chemicals of Raleigh-Durham, N.C., under the product identification number 97903. Another chemical treatment that has been used with the strands 16 is a non-aqueous based polyester chemical treatment. This polyester chemical treatment a polyester resin available from Alpha/Owens-Corning of Collierville, Tenn., under the product identification number E830. To produce this polyester chemical treatment, 1% by weight of benzoyl peroxide powder is mixed into 5% by weight styrene. This styrene/benzoyl peroxide mixture is then mixed with 2% by weight of the silane gamma-methacryloxypropyltrimethoxysilane (A174), available from Witco Chemical Company of Chicago, Ill., and 92% by weight of the polyester resin E830.

For the present fabric 10, a suitable chemical treatment is one which is compatible with the polymeric material 19. In general, for a composite article to exhibit satisfactory mechanical properties between its reinforcing fibers and matrix material, it is desirable for any chemical treatment applied to the reinforcing fibers to be compatible with the matrix material. Likewise, for the fabric 10, it is desirable for any chemical treatment being used in the strands 16 to be compatible with the polymeric material 19, which forms at least part of the matrix for the reinforcing fibers 17 of the fabric 10. In general, a chemical treatment is considered compatible with the polymeric material if it is capable of interacting with and/or reacting with the polymeric material. In addition, a chemical treatment can be considered compatible if stress loads (static or dynamic), applied to a fabric 10 formed using such a chemical treatment, are transferable from the polymeric material 19 to the reinforcing fibers 17 or from the fibers 17 to the polymeric material 19 through the chemical treatment formed as an interface therebetween. The applied chemical treatment may comprise the same type of material as the polymeric material. In addition, the compatible chemical treatments may be miscible in the polymeric material, in whole or in part, and/or may form a separate phase from the polymeric material.

Referring to FIG. 1, one embodiment of the fabric 10 comprises a plurality of laminae 12, four of which are shown in FIG. 1 for illustration purposes. The fabric 10 includes a first lamina 14, a second lamina 18, a third lamina 20 and a fourth lamina 22. Each lamina 14, 18, 20 and 22 comprises a plurality of strands 16 which each comprises a plurality of reinforcing fibers 17 and at least one polymeric material 19. The laminae 14, 18, 20, and 22 are joined together by fusing a portion of the polymeric material 19 of one lamina 12 with a portion of the polymeric material 19 of another lamina 12. For example, polymeric material 19 from the strands 16 of the lamina 14 fuses with the polymeric material 19 from the strands 16 of the lamina 18; polymeric material 19 from the strands 16 of the lamina 18 fuses with the polymeric material 19 from the strands 16 of the lamina 20; and polymeric material 19 from the strands 16 of the lamina 20 fuses with the polymeric material 19 from the strands 16 of the lamina 22.

For any fabric 10, the polymeric material 19 of the laminae 12 are sufficiently melted and fused together to provide the fabric 10 with the mechanical properties desired. The polymeric material 19 of the strands 16 are preferably melted and fused together only at localized areas so that the resulting fabric 10 is flexible enough to be rolled upon itself as described herein. The polymeric material 19 from each of of the strands 16 forms all, substantially all, or at least part, of the matrix for the reinforcing fibers 17 of the fabric 10, according to the present invention. All of the matrix refers to the polymeric material 19 from the strands 16 providing all of the matrix except for that formed by any chemical treatment that may have been applied to the reinforcing fibers 17 or any fibers made of the polymeric material 19. Substantially all of the matrix refers to the polymeric material 19 from the strands 16 being enough to provide a matrix for all of the reinforcing fibers 17 in the fabric 10. It does not preclude the use of additional matrix material from a source other than the strands 16.

In the fabric 10 shown in FIG. 1, the various laminae 14, 18, 20 and 22 are positioned angularly in relation to each other. The first lamina 14 is arranged angularly to the second lamina 18 which is arranged angularly to the third lamina 20. The third lamina 20 is arranged angularly to the fourth lamina 22. By arranging the various lamina in this manner, the fabric 10 is provided with reinforcement against loads applied along both its machine direction (i.e., length) and its cross machine direction (i.e., width). The strands 16 forming any lamina of the fabric 10 can be positioned next to each other or they can be spaced apart. For some applications, a porous fabric 10 is desirable. For example, having a porous fabric 10 would allow air to flow through the fabric 10 in order to compensate for air pressure differences on either side of the fabric 10. Further, a porous fabric 10 would allow sunlight to filter though the fabric 10 to thereby provide a shading effect. For such an application, the strands 16 in each lamina of the fabric 10 can be sufficiently spaced apart to form openings through the fabric 10. Laminae having strands spaced up to about 1 inch (2.54 cm) apart have been produced. It is believed that fabrics 10 with laminae having strands 16 spaced even further apart can also be successfully produced.

As shown in FIG. 1, each of the laminae 14, 18, 20 and 22 is in the form of a reinforcement mat 24 which has a first layer 26 of the strands 16 and a second layer 28 of the strands 16. The first and second layers 26 and 28 are positioned relative to one another so that the strands 16 of one layer 26 are at an angle 8 from the strands 16 of the other layer 28. It is desirable for the angle 8 to be in the range of from about 6° to about 174°. It is more desirable for the angle $\Theta$ to be in the range of from about 60° to about 120°. The first layer 26 of strands 16 is angularly positioned in relation to the second layer 28 of strands 16 so that each lamina 12 can more efficiently carry loads.

During the formation process of mat 24, the first and second layers 26 and 28 are brought together and heated such that at least a portion of the polymeric material 19 incorporated into the first and second layers 26 and 28 bond together so as to join the strands 16 of the first and second layers 26 and 28 to one another to form the mat 24. In other words, the polymeric material 19 of the layers 26 and 28 are sufficiently fused together to provide the lamina 12 with the mechanical properties desired, i.e., flexibility and strength. The polymeric material 19 of the layers 26 and 28 are fused together such as at localized areas so as to maintain the flexibility of the mat 24. A fabric 10 made from one or more of the mats 24 may be rolled upon itself as with a typical window shade. A process for forming such a mat 24 and a description of the mat 24 are set out in copending U.S. patent application Ser. No. 08/713,319 (Attorney Docket No. 24084A), filed Sep. 13, 1996, entitled "PROCESS AND APPARATUS FOR MAKING A REINFORCING MAT" and in copending U.S. patent application Ser. No. 08/713,318 (Attorney Docket No. 23689A), filed Sep. 13, 1996, entitled "A REINFORCEMENT MAT." Both of these applications are hereby incorporated by reference in their entireties.

As an option, one or more of the mats 24 of the fabric 10 can further include a third layer 30 of the strands 16. The strands 16 of the layer 30 run lengthwise or in the machine direction of the mat 24. The polymeric material 19 from the layer 30 is sufficiently fused with the polymeric material 19 from one or more of the other layers 26 and 28. Each mat 24 may also include a layer or film 31 of polymeric material sandwiched between and fused to any two of the layers 26, 28, and/or 30 to serve as part of the matrix for the reinforcing fibers 17.

As stated above, the laminae 12, which form the fabric 10 can be positioned in an angular relation to each other. Particularly, each of the laminae 12 can be positioned in an angular relation to the lamina 12 on one or either side thereof. It is desirable for the angle between two adjacent laminae 12 to be in the range from about 30° to about 150°. It is more desirable for the angle between consecutive laminae 12 to be in the range of from about 60° to about 120°. It can be even more desirable for the laminae 12 to be arranged approximately perpendicular to each other (i.e., at an angle of about 90°).

The fabric 10 can be formed from two to sixteen of the laminae 12, such as the reinforcement mats 24 described above, or possibly even more of the laminae 12. It can be desirable for the fabric 10 to be formed from six to twelve, or even from eight to ten, of the laminae 12, such as the reinforcement mats 24 described above.

The polymeric material 19 in the strands 16 of the laminae 12 may be melted and fused together at localized areas so as to join the laminae 12 to form the fabric 10. Melting and fusing preferably occurs only at localized areas such that the fabric 10 remains flexible to be rolled upon itself. This is in contrast to the molding process, e.g., a compression molding process, required to form the panels in the copending applications entitled "IMPACT AND PUNCTURE RESISTANT SHUTTERS" and "PROTECTIVE COVERINGS," incorporated by reference above. One or more weld lines and/or a plurality of spot welds may be effected using a heated tool which is applied to one or more of the laminae 12 using sufficient pressure to effect heating and fusing along a weld line or a specific point through each of the plurality of laminae 12. Preferably, the area to be welded or fused together on each of the laminae 12 is exposed to a high temperature of approximately 425°, but not exceeding 450°. Alternatively, the polymeric material 19 in the strands 16 of the laminae 12 may be fused together using an ultrasonic welding system, such as the H5001 CV20 hand held unit commercially available from Sonics & Materials, Inc. Pressure is also applied when using the ultrasonic welding unit.

The fabric 10 may be further reinforced by means of additional reinforcing materials including those selected from the group consisting of glass fibers, graphite fibers, aramid fibers, silicon carbide fibers and other fibers having suitable reinforcing properties and combinations thereof. It can be desirable for these additional reinforcing materials to be formed into nonwoven or woven mats 43 (see FIGS. 2 and 3). By "nonwoven", it is meant that the reinforcing materials in the mat are not systematically woven together. One such reinforcing material is a nonwoven glass fiber mat, such as the continuous strand mats available from Owens Corning, of Toledo, Ohio, under the product designations M8608 and M8610. These types of mats are made of glass fibers laid in a continuous swirl pattern. Nonwoven glass fiber mats can be formed by air laying glass fibers onto a conveyor and then passing the air laid fibers through a compression or dessication process to form the mat. One nonwoven glass fiber mat 43 can be sandwiched between one or more pairs of adjacent laminae 12, the laminae 12 can be sandwiched between a pair of the nonwoven glass fiber mats 43 (see FIGS. 2 and 3), or both. The nonwoven glass fiber mats described above are sufficiently flexible to be rolled.

The fabric 10 may also include a surface finish to enhance the appearance and/or to further protect the fabric. It is desirable for the surface finish to have good weatherability. Useful surface finishes include, for example, plastic films, ultraviolet protectants, water repellents, canvases (e.g., awning material).

Figure 2:
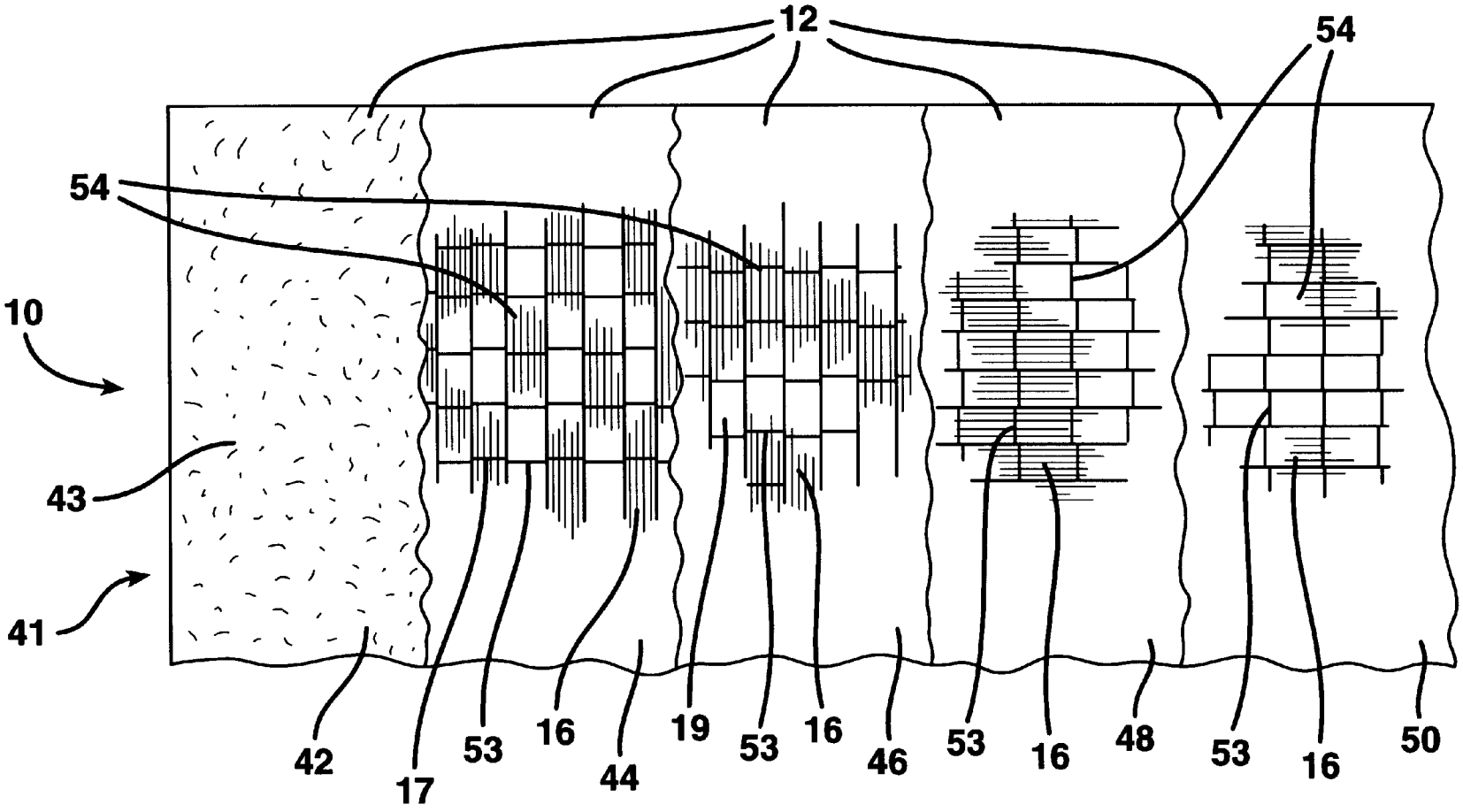
FIG. 2 presents a cutaway view showing the laminae of a fabric formed according to another embodiment of this invention.

Referring to FIG. 2, another embodiment of the fabric 10 comprises laminae 12 formed from strands 16 which are woven together by means of one or more threads 53 running at an angle (e.g., transversely) to the strands 16 to form woven mats 54. The example of the fabric 10 shown in FIG. 2 includes a first lamina 42, a second lamina 44, a third lamina 46, a fourth lamina 48 and a fifth lamina 50. Each of the laminae 44, 46, 48 and 50 comprises a plurality of strands 16 which each comprise a plurality of reinforcing fibers 17 and at least one polymeric material 19. The laminae 44, 46, 48 and 50 are positioned between a pair of lamina 42 (one shown in FIG. 2) which each comprises additional reinforcing materials, such as that described above. In the embodiment shown, the additional reinforcing materials forming the lamina 42 are nonwoven mats 43.

In the embodiment shown in FIG. 2, the first and second laminae 44 and 46 are arranged with their strands 16 parallel to each other and the third and fourth laminae 48 and 50 are arranged with their strands 16 parallel to each other. The first and second woven lamina 44 and 46 are arranged in an angular relation, here about 90°, to the third and fourth woven lamina 48 and 50. The angular arrangement of the laminae 44, 46, 48 and 50, as shown or at any other angle, provides the fabric 10 with reinforcement in both its machine direction and its cross machine direction, i.e., along both its length and its width.

In one modification of the fabric 10, six laminae 12, formed from woven mats such as mat 54, are arranged in pairs, with the strands 16 in each pair being oriented in the same direction. A first pair of the woven mats 54 is sandwiched between a second pair and a third pair of the woven mats 54. The strands 16 of the first pair of mats 54 are positioned in an angular relation to the strands 16 of both the second and third pairs of mats 54 to form a laminated structure. This laminated structure is sandwiched between a pair of nonwoven fiber mats 43.

The strands 16 of the fabric 10 can also be woven together by means of a conventional weaving process known in the art to weave glass fibers into mats 54. Typically, the strands 16 are woven together by threads 53 running transverse to the strands 16. These threads 53 can be made from any suitable thread fiber including those selected from the group consisting of glass fibers, nylon fibers, polyamide fibers, polypropylene fibers, polyester fibers, polyethylene fibers, and polyphenylene sulfide fibers. It can be desirable for the thread 53 to be formed from the same material as the polymeric material 19 used in the strands 16. Another strand 16 could also be used for the thread 53.

To maintain the strands 16 in position in the woven mat 54 and to prevent fraying, the edges of the mat 54 can be stitched after the strands 16 have been woven together. The ends of the strands 16 can also be heated to at least partially melt the polymeric material 19 and, thereby, prevent movement of individual fibers in the strands 16. Such heating is particularly desirable with commingled strands 16.

The fabric 10 can be formed from two to sixteen or even more laminae 12, such as the woven mats 54, and additional reinforcing materials, such as nonwoven fiber mats 43. It is desirable for the fabric 10 to be formed from four to twelve, or even more, of such laminae 12, depending on the diameter of the strands 16 and the application for which the fabric 10 is being used.

Figure 3:
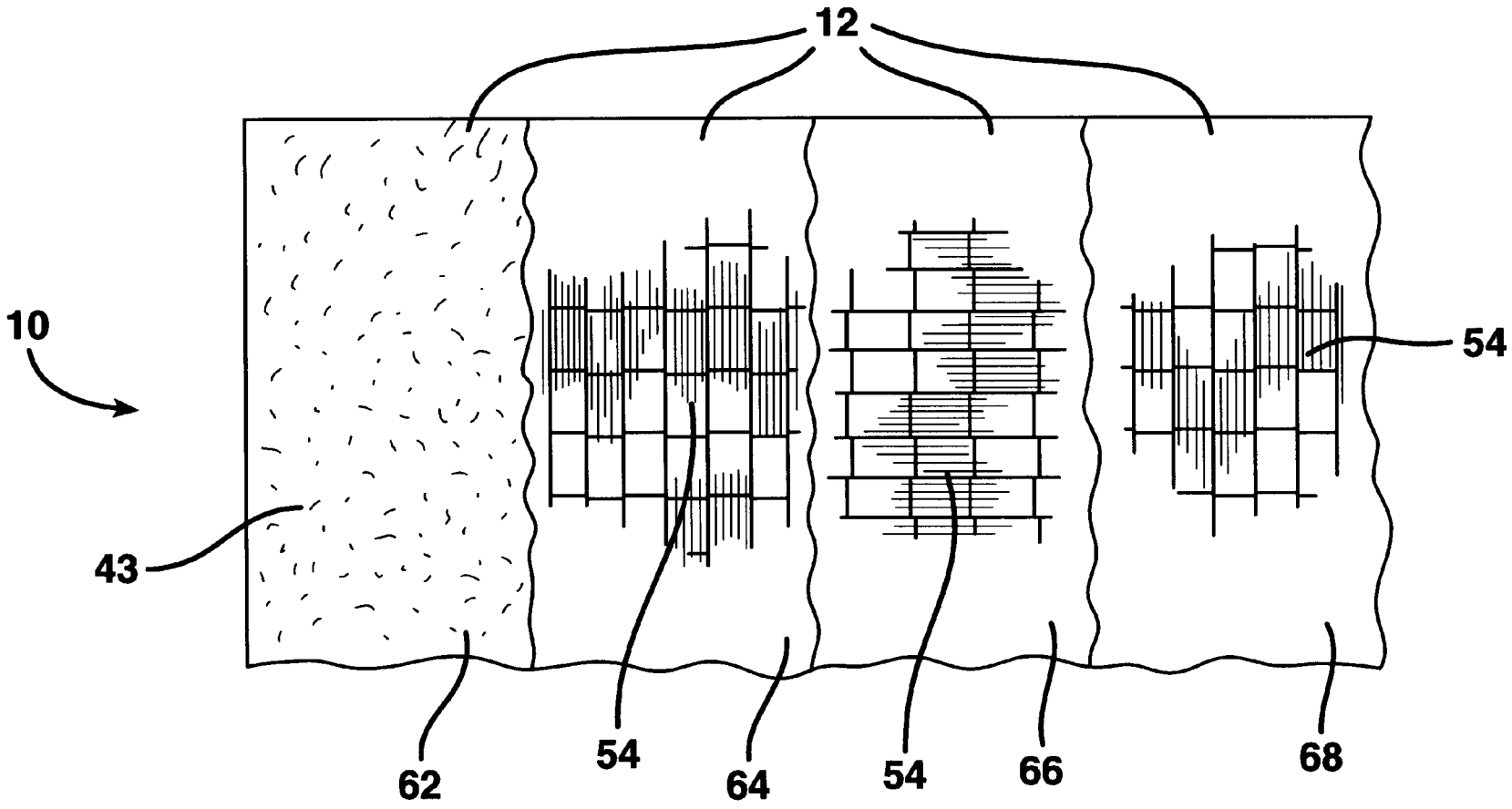
FIG. 3 present a cutaway view of a modification of the fabric of FIG. 2.

Referring to FIG. 3, an alternative fabric 10 comprises a first lamina 62 formed from an additional reinforcing material which, in the embodiment shown, is a nonwoven glass fiber mat 43; a second lamina 64 formed from a woven mat 54; a third lamina 66 formed from a woven mat 54; and a fourth lamina 68 formed from a woven mat 54. The second lamina 64 is shown with its strands 16 oriented angularly, as shown about 90°, in relation to the strands 16 of the third lamina 66. The strands 16 of the fourth lamina 68 are shown as being positioned about parallel to the strands 16 of the second lamina 64 (i.e., about perpendicular to the strands 16 of the third lamina 66). However, the laminae 62, 64, 66 and 68 can be oriented in any desired manner to reinforce the alternative fabric 10. Again, by positioning the various woven laminae 64 and 66 angularly in relation to each other, the fabric 10 is provided with reinforcement against loads applied along both its machine direction (i.e., length) and its cross machine direction (i.e., width).

In another modification of the fabric 10, an additional reinforcing material, such as a woven or nonwoven mat 43 made from aramid fibers, is positioned between a first lamina and a second lamina, both of which are formed from woven fiber mats, such as the mat 54. The first lamina is positioned with its strands 16 in an angular relation to those of the second woven lamina. A third lamina, formed from a woven fiber mat, such as the mat 54, is layered on the first lamina with its strands 16 in an angular relation to those of the first lamina. A fourth lamina, formed from a woven fiber mat, such as the mat 54, is layered on the second lamina with its strands 16 positioned in an angular relation to the strands 16 of the second lamina to form a laminated structure. This laminated structure is sandwiched between two layers of additional reinforcing materials, such as the nonwoven fiber mats 43 described above.

The fabric 10 may also be formed using a standard textile weaving process. Once the glass fibers and polymeric fibers are weaved together, the glass and polymeric fibers are "spot welded" or heated so as to fuse them together.

Any of the above fabrics 10 can be painted, coated with a protective coating and processed further if necessary. In addition, the final surface finish (e.g., a canvas) can be incorporated as an integral part of the fabric 10.

The fabric 10 of this invention can be used to make protective coverings for elements such as windows mounted in a structure and/or awnings. The fabrics 10 are also useful for making protective coverings for cash windows of financial institutions, coverings for kiosks and carts in open areas of shopping malls, side panels for tractor trailers, boat hulls, aircraft parts and other articles and parts for which impact resistance and/or puncture resistance are desired.

Figure 4:
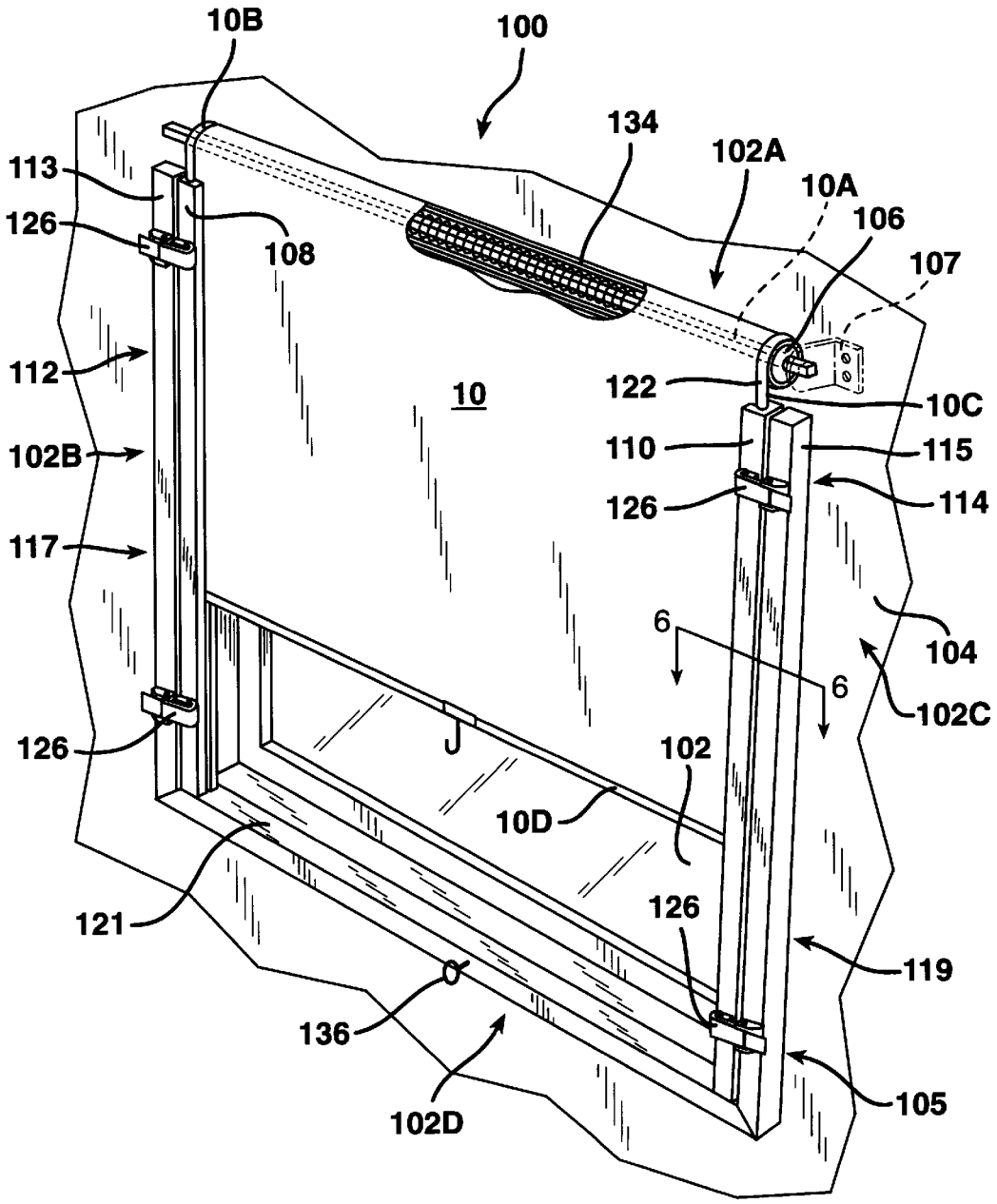
FIG. 4 presents a perspective view of a protective covering formed of a fabric according to an aspect of this invention.

FIG. 4 presents a perspective view of a protective covering 100 for protecting or covering an element or window 102 mounted in a structure 104. The protective covering 100 comprises a fabric 10, such as one of the fabric embodiments described above, and support apparatus 105 coupled to the structure 104 adjacent to the window 102. The support apparatus 105 comprises a roller 106, a first frame member 108, a second frame member 110, a first tensioning device 112 and a second tensioning device 114. In the illustrated embodiment, a first end 10A of the fabric 10 is secured to the roller 106 which is mounted over a top or first end 102A of the window 102 by a set of brackets 107 for ease of storage when the fabric 10 is not being used to cover or protect the window 102, similar to a conventional window shade. It will be appreciated by those skilled in the art that a number of different brackets or fastening devices may be used to secure the roller 106 to the structure 104.

The fabric 10 may be secured to the roller 106 in a variety of ways. In the illustrated embodiment, the first end 10A of the fabric 10 is wrapped about the roller 106 so that a portion of the fabric 10 extends over on itself. The overlapping portions are then fused or "welded" together by heating. It will be appreciated by those skilled in the art that conventional adhesives and/or fasteners may also be used to secure the fabric 10 to the roller 106.

Figure 5:
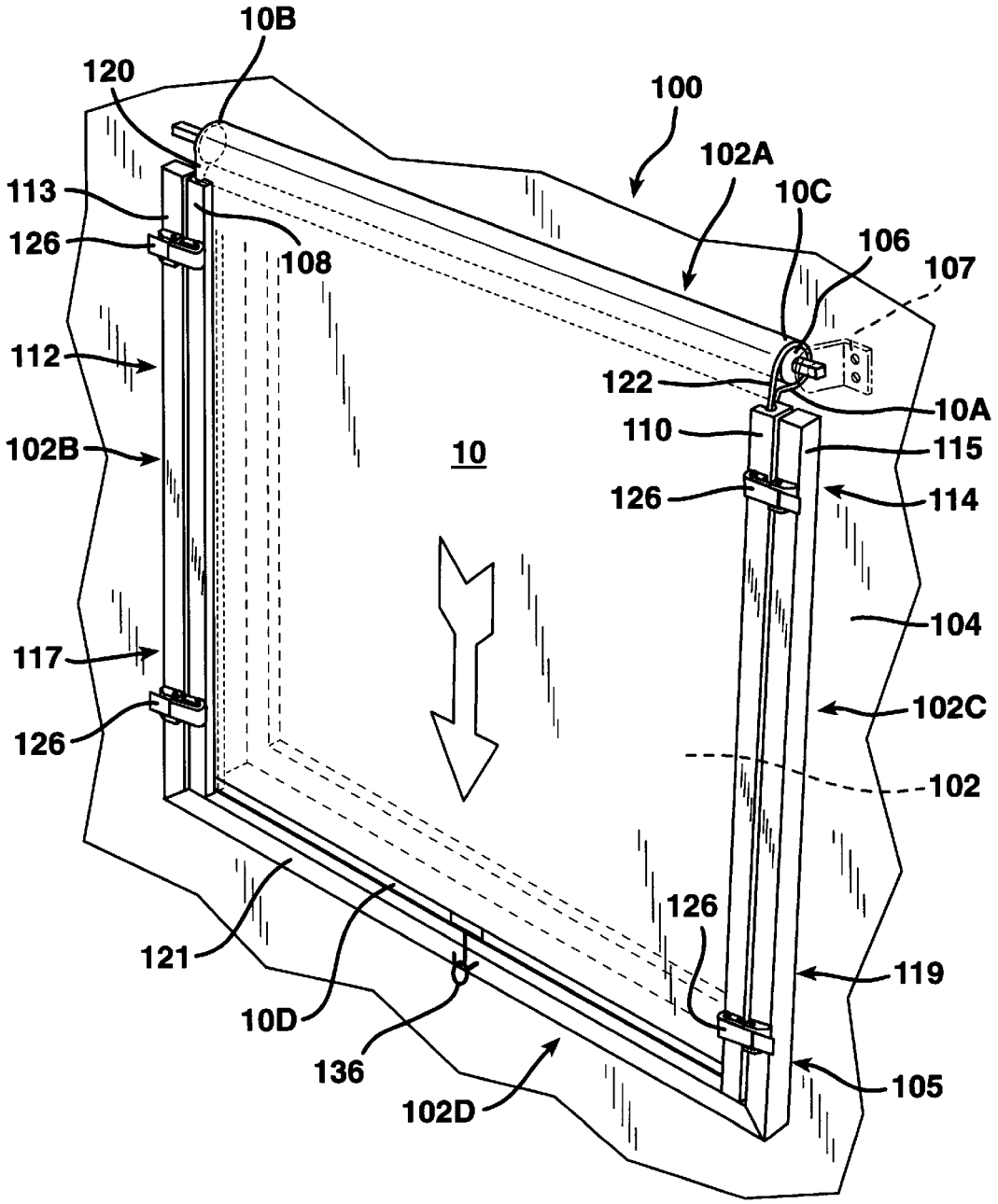
FIG. 5 presents a perspective view of the shutter of FIG. 4 in another position.

When the fabric 10 is in a fully retracted position, it is completely or near completely wrapped around the roller 106. When the fabric 10 is in a fully extended position such that it covers all or nearly all of the window 102, it is substantially unwrapped from the roller 106. The fabric 10 is sized so that the window 102 is substantially covered when the fabric 10 is in its fully extended position, see also FIG. 5. It will be appreciated by those skilled in the art that the first end 10A of the fabric 10 may be secured directly to the structure 104 adjacent to the first end 102A of the window without the use of the roller 106. The fabric 10 may then be folded and stored in a container (not shown) when not in use.

The first and second frame members 108 and 110 are positioned on opposing sides 102B and 102C of the window 102. A first side 10B of the fabric 10 is positioned within the first frame member 108 while a second side 10C of the fabric 10 is positioned within the second frame member 110. The fabric 10 is secured within the frame members 108 and 110 when in the fully extended position. As shown in FIG. 6, the frame members 108 and 110 each include a longitudinal cavity 116 narrowing down to a longitudinal slot 118.

As shown in FIG. 7, the protective covering 100 further includes first and second elongated members 120 and 122 coupled to the first and second sides 10B and 10C of the fabric 10, respectively. Referring again to FIG. 6, the elongated members 120 and 122 extend into the first and second frame member cavities 116 along with portions of the first and second fabric sides 10B and 10C when the fabric 10 is extended. As noted above, the fabric 10 extends through the two slots 118 in the frame members 108 and 110 when the fabric 10 is extended. The elongated members 120 and 122 are preferably formed from an elastic material which has sufficient strength and rigidity such that the members 120 and 122 and the sides 10B, 10C of the fabric 10 are maintained within the frame members 108, 110 when the fabric 10 is subjected to an impact force below a predetermined magnitude which might result during a storm. The elongated members 120 and 122 also perform a shock or energy absorbing function by absorbing some of the energy caused by the impact. To further the shock absorbing capabilities of the elongated members 120 and 122, they are provided with one or more longitudinal bores 124 which allow them to more easily compress and expand.

The size and configuration of the elongated members 120 and 122 is such that they will not adversely affect the ability of the fabric 10 to be rolled or folded. In the illustrated embodiment and as shown in FIGS. 6 and 7, the elongated members 120 and 122 are formed from ethylenepropylene diene monomer (EPDM) rubber which is coupled to the fabric 10 by wrapping the sides of the fabric 10 around the rubber members 120 and 122 and then fusing or "welding" the overlapping portions of the fabric 10 together. It will be appreciated by those skilled in the art that the elongated members 120 and 122 may be coupled to the fabric 10 by other means.

Once the fabric 10 is in its fully extended position, lateral tension is applied to the fabric 10 by adjusting the lateral positions of the first and second frame members 108 and 110 via the first and second tensioning devices 112 and 114. The first tensioning device 112 includes a first tensioning frame member 113 secured with conventional fasteners to the structure 104 adjacent to the first side 102B of the window 102. The second tensioning device 114 includes a second tensioning frame member 115 secured with conventional fasteners to the structure 104 adjacent to the second side 102C of the window 102. In the illustrated embodiment, the first and second frame members 108 and 110 are moveably coupled to the first and second tensioning frame members 113 and 115 via a plurality of pins 109 (only one of which is shown in FIG. 6), and thereby form first and second integral frame units 117, 119. The frame members 108 and 110 may move back and forth laterally from the tensioning frame members 113 and 115 with the range of motion being a function of the length of the pins 109. The first and second frame members 108 and 110 are connected to the structure 104 only by way of the frame members 113 and 115. The first and second frame members 108 and 110 are pinned at several points along their length to the first and second tensioning frame members 113 and 115 by the pins 109. The pins 109 are positioned in corresponding aligned holes in the members 108, 110, 113 and 115. The pins 109 are sized to support the weight of the first and second frame members 108 and 110 and to allow movement of the first and second elongated members 120, 122 through the members 108, 110. The first and second integral frame units 117 and 119 are coupled to a cross frame member 121 positioned adjacent a bottom or second end 102D of the window 102. The cross frame member 121 may be secured to the structure 104 adjacent to the window 102 using conventional fasteners.

In the embodiment illustrated in FIG. 6, the tensioning devices 112 and 114 each include two draw latches 126. Each draw latch includes a base 128, a clip 130 and a clip holder 132. The base 128 and the clip holder 132 are coupled to their respective tensioning frame member 113, 115 using conventional fasteners (not shown). A first end 130A of the clip 130 is shaped to engage its corresponding clip holder 132. The clip 130 is rotatably supported within the base 128. The lateral position of each frame member 108, 110 is adjusted towards its respective tensioning frame member 113, 115 as a second end 130B of the clip 130 is moved down towards the tensioning frame member 113, 115. By locking the clip 130 in place, tension is applied to the fabric 10. It will be appreciated by those skilled in the art that other devices may be used to apply tension to the fabric 10. It will be further appreciated by those skilled in the art that the first and second frame members 108 and 110 may be rigidly coupled to the structure using conventional fasteners with the fabric 10 prestressed between them.

The fabric 10 may be raised or lowered in place in a variety of different ways. For example, as shown in FIG. 4, the roller 106 may include a torsion spring 134 for keeping the fabric rolled tightly around the roller 106. The fabric 10 may then be raised and lowered manually by simply applying a downward force to lower the fabric 10 into position. The torsion spring 134 may be associated with a conventional locking mechanism (not shown) such that the fabric is maintained in the desired position once the downward force is removed. A second end 10D of the fabric 10 may be fastened to the cross member 121 using a fastener 136 with the fabric 10 in the fully extended position. The fabric 10 may then be raised by applying a slight downward force to disengage the locking mechanism and then raising to the desired height. A hand crank (not shown) or a chain loop and pulley (not shown) coupled to either the roller 106 or the second fabric end 10D may also be used to raise and lower the fabric 10. Further, a motor (not shown) may also be used to raise and lower the fabric 10 automatically. Such a motor may be used to rotate the roller 106 directly or indirectly or such a motor may be used to apply a force to the second end 10D of the fabric, also directly or indirectly. The second end 10D of the fabric 10 may include a seam (not shown) or a substantially rigid laterally extending member (not shown) to keep the end 10D from fraying. A substantially rigid laterally extending member would also provide a grippable surface for raising and lowering the fabric 10.

Figure 8:
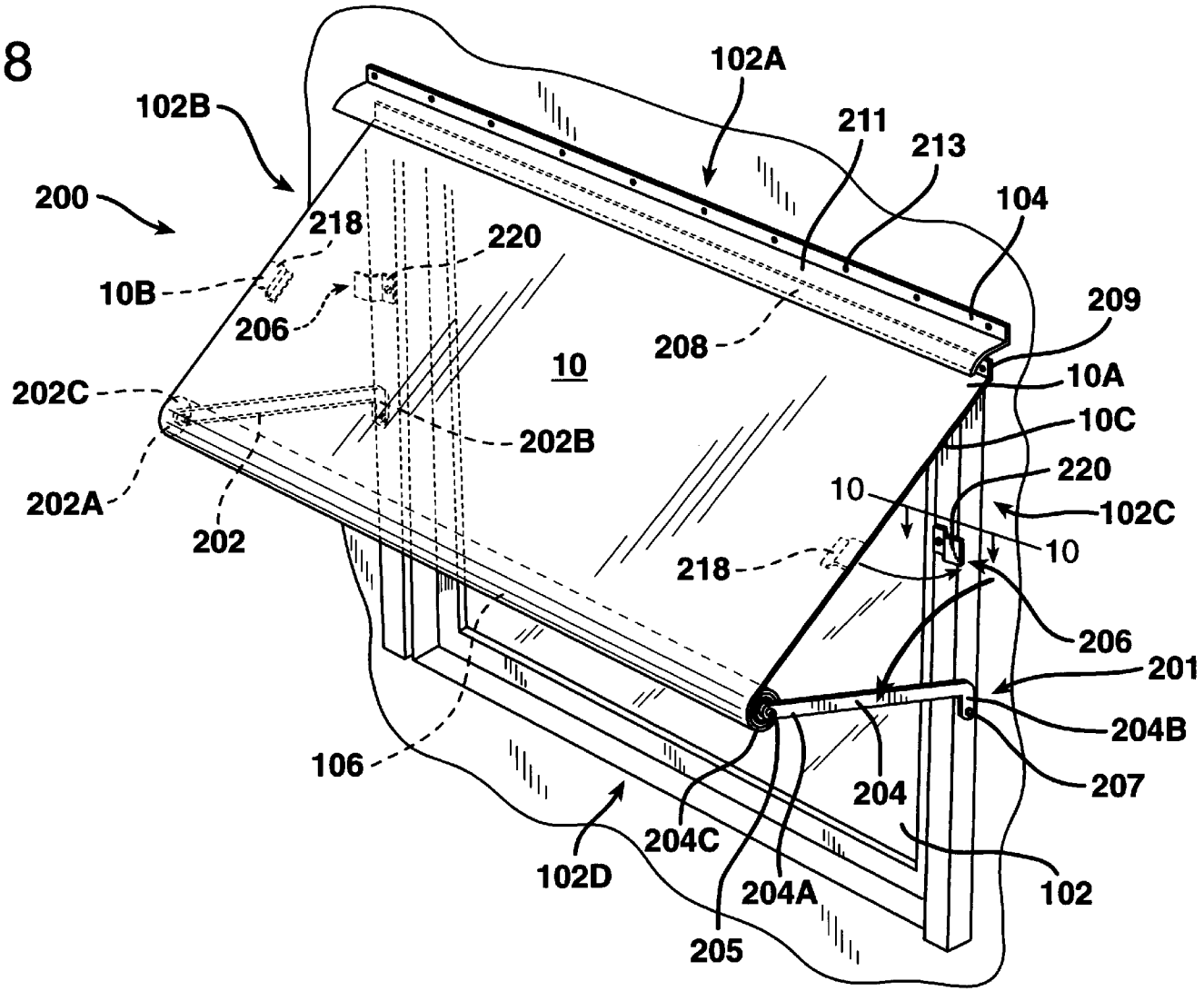
FIG. 8 presents a perspective view of a combination awning and protective covering formed of a fabric according to another aspect of this invention.

Referring now to FIG. 8 where like reference numerals refer to like elements, another aspect of the present invention is shown in which the fabric 10 is used to form a combination awning and protective covering 200 for protecting and/or covering the window 102. The awning and protective covering 200 includes the fabric 10 and support apparatus 201. The support apparatus 201 includes the roller 106, a first arm 202, a second arm 204 and locking elements 206. In the illustrated embodiment, the first end 10A of the fabric 10 is coupled to the structure 104 over the first end 102A of the window 102 using a bracket 208 and conventional fasteners 209. The second end 10D of the fabric 10 is coupled to the roller 106 as described above. The roller 106 is rotatably coupled to first ends 202A, 204A of the first and second arms 202 and 204, respectively, by a rod 205 extending through the roller 106 and engaging support holes 202C and 204C in the arms 202 and 204. The ends of the rod 205 may be secured in the support holes by any conventional method, such as by locking pins. A second end 202B and 204B of each of the first and second arms 202, 204 is rotatably coupled to the structure 104 adjacent to one of the opposing sides 102B and 102C of the window 102 using conventional fasteners 207. It will be appreciated by those skilled in the art that the roller 106 may be secured over the first part 102A of the window 102 using one or more brackets while the first end 10A of the fabric 10 is secured to the first and second arms 202 and 204 via an appropriate mounting bracket.

Figure 9:
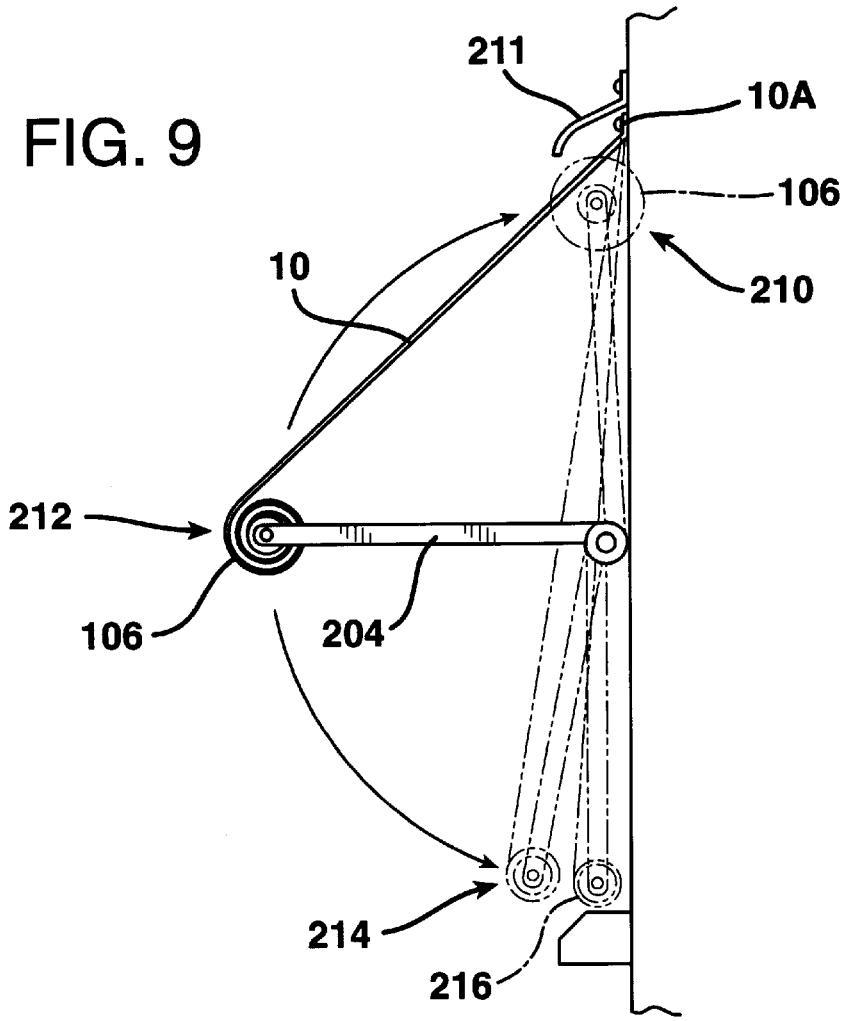
FIG. 9 presents a side view of the combination awning and protective covering of FIG. 8 in a plurality of positions.

As shown in FIG. 9, the first and second arms 202 and 204 have at least four main positions: a first position 210 in which the fabric 10 is fully retracted, an intermediate position 212 in which the fabric 10 partially covers the window 102, a second position 214 in which the fabric is fully extended, and a third position 216 in which the fabric 10 is placed under tension while fully extended. In the first position 210, the first and second arms 202 and 204 are substantially parallel with the plane of the window 102 and the fabric 10 is fully retracted as it is substantially wrapped around the roller 106. The fabric 10 is also positioned under a roll cover 211 for protection against the elements when not in use. In the illustrated embodiment, the roll cover 211 is mounted to the structure 104 using conventional fasteners 213. In the intermediate position 212, the fabric 10 is partially unwound from the roller 10 and extends at an angle over the window 102. In the intermediate position 212, the fabric 10 acts as an awning by partially covering the window 102. The extent of window coverage may be varied by adjusting the intermediate position 212 to any desired angular orientation. The fabric 10 is sized so that when in the second position 214, the fabric 10 substantially covers the window 102 with the fabric 10 fully extended. The protective covering 200 is locked in place by rotating the arms 202, 204 a set number of degrees past the second position 214 to the third position 216 thereby placing the fabric 10 under tension. It will be appreciated by those skilled in the art that the amount of tension placed on the fabric 10 is determined in part by the length of the fabric 10, the length of the arms 202 and 204 and the degree of rotation between the second and third positions.

In the illustrated embodiment, the roller 106 includes the torsion spring 134 and the locking mechanism described above to lock the fabric 10 in the desired position. It will be appreciated by those skilled in the art that the arms 202 and 204 may singularly or in combination with the torsion spring and locking mechanism be locked in place using a conventional pin and hole system. For example, the second ends 202B and 204B of the arms 202 and 204 may include an end portion having a plurality of holes therein one of which is aligned with a hole in a bracket secured to the structure 104. The aligned holes in the end portion and the bracket receive a pin so as to maintain the arms 202 and 204 in a desired position. The fabric 10 may also be locked in place if the third position is at least partly past the toggle point of the support apparatus 201, i.e., the second end 10D of the fabric 10 with the fabric 10 in the third position 216 extends past a plane extending through the mounting point of the first and second arms 202 and 204.

Figure 10:
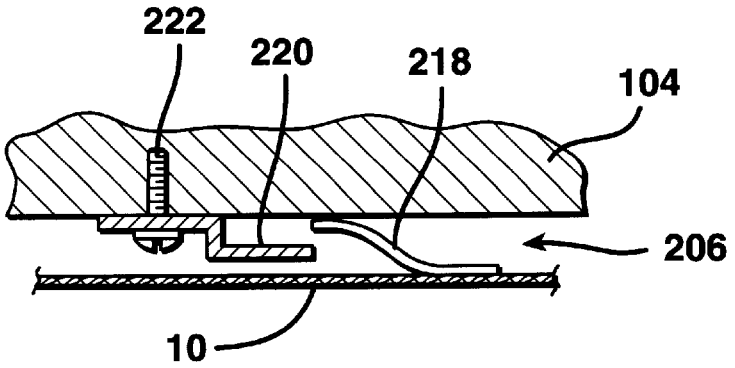
FIG. 10 presents a sectional view of the combination awning and protective covering of FIG. 8, taken along lines 10—10.

To further secure the fabric 10, the locking elements 206, at least one on each side of the fabric 10, engage the fabric sides 10B and 10C when the fabric 10 is subjected to an impact. As shown in FIG. 10, each of the locking elements 206 include a first clip 218 coupled to the fabric 10 using an adhesive or conventional fastener and a second clip 220 coupled to the window 102 using conventional fasteners 222. The clips 218 and 220 are configured such that with the arms 202 and 204 in the third position 216, the first clips 218 will engage the second clips 220 upon the application of an impact force at a point on the fabric 10 intermediate the sides 10B and 10C. The locking elements 206 further function to tension the fabric 10 when a force is applied to the fabric 10 thereby reducing the deflection of the fabric 10 when hit by an object.

The fabric 10 of the present invention is flexible enough to be rolled or folded upon itself yet strong enough to withstand an impact of at least a 9 lb. rigid 2"×4" board traveling at 50 ft/sec, thereby providing adequate protection for a window or other structural element. The fabric 10 may include additional decorative features to improve the aesthetics of the protective covering 100 or the combination awning and protective covering 200.

While certain representative embodiments and details have been shown for the purpose of illustrating the invention, it will be apparent to those skilled in the art that various changes in the product and method described herein may be made without departing from the scope of the invention, which is defined in the appended claims.

What is claimed is:

1. A protective covering for protecting at least a portion of an element secured in a structure, said protective covering comprising a fiber reinforced polymeric fabric comprising a lamination of at least first and second laminae, each of which is formed from a plurality of strands, at least one of said strands comprising polymer fibers commingled with reinforcing fibers, said first lamina being arranged angularly to said second lamina and a support apparatus coupled to said structure for supporting said fabric adjacent to said element, said fabric being capable of covering said portion of said element and being flexible enough to be rolled upon itself.

2. The protective covering of claim 1, wherein said support apparatus comprises a roller, a first end of said fabric being secured to said roller, said fabric being rolled on said roller when in a fully retracted position and being substantially unrolled from said roller when in a fully extended position.

3. The protective covering of claim 2, wherein said fabric is rolled and unrolled from said roller automatically.

4. The protective covering of claim 2, wherein said roller comprises a torsion spring so that said fabric is tightly rolled on said roller.

5. The protective covering of claim 2, wherein said support apparatus further comprises first and second arms rotatably coupled to said structure on opposing sides of said element, one of said roller and a second end of said fabric being coupled to said first and second arms and the other of said roller and said second end of said fabric being coupled to said structure adjacent to a first end of said element, said first and second arms being in a first position when said fabric is in said fully retracted position, a second position when said fabric is in said fully extended position, and at least one intermediate position when said fabric partially extends over said element.

6. The protective covering of claim 5, wherein said fabric is placed under tension when said first and second arms are in a third position rotated past said second position by a predetermined number of degrees.

7. The protective covering of claim 6, wherein said support apparatus further comprises a locking element on each of said opposing sides of said element for securing first and second sides of said fabric to said structure.

8. The protective covering of claim 7, wherein said locking elements grip said fabric so as to reduce deflection of said fabric toward said element when hit by an object.

9. The protective covering of claim 5, wherein said roller is coupled to said first and second arms.

10. A combination awning and protective covering for covering and protecting a window mounted in a structure comprising:

a fabric;

first and second arms rotatably coupled to the structure on opposing sides of said window;

a roller coupled to one of said first and second arms and to the structure adjacent to a first end of said window, a first end of said fabric being secured to said roller, said fabric being rolled on said roller when in a fully retracted position and being substantially unrolled from said roller when in a fully extended position, the other end of said fabric being secured to the other of said first and second arms and the structure adjacent to said first end of said window;

said first and second arms being in a first position with said fabric in said fully retracted position, a second position with said fabric in said fully extended position, and at least one intermediate position as said fabric partially extends over said window; and locking elements coupled to said structure on said opposing sides of said window for securing first and second sides of said fabric to said structure so as to prevent substantial deflection of said fabric toward said window when a force is applied to said fabric.

11. The combination awning and protective covering of claim 10, wherein said fabric is placed under tension when said first and second arms are in a third position rotated past said second position by a predetermined number of degrees.

12. The combination awning and protective covering of claim 10, wherein said fabric comprises a fiber reinforced polymeric fabric.

13. The combination awning and protective covering of claim 10, wherein said roller is coupled to said first and second arms.

14. A protective covering for protecting at least a portion of an element secured in a structure, said protective covering comprising a fiber reinforced polymeric fabric comprising a lamination of at least first and second laminae, each of which is formed from a plurality of strands, at least one of said strands comprising one of glass fibers, aramid fibers, graphite fibers and silicon fibers, said first lamina being arranged angularly to said second lamina and a support apparatus coupled to said structure for supporting said fabric adjacent to said element, said fabric being capable of covering said portion of said element and being flexible enough to be rolled upon itself.

15. A protective covering as set out in claim 14, where said at least one strand further comprises polymer fibers commingled with said one of glass fibers, aramid fibers, graphite fibers and silicon fibers.

* * * * *